US005655347A

United States Patent [19]

Mahieu

[11] Patent Number: 5,655,347

[45] Date of Patent: Aug. 12, 1997

[54] BIARCH-FRAMING MEMBER FOR ARCHED STRUCTURES

[76] Inventor: William Ray Mahieu, R.R. 4, 18700 N. Jay Jay, Centralia, Mo. 65240

[21] Appl. No.: 430,576

[22] Filed: Apr. 28, 1995

[51] Int. Cl.[6] ..... E04B 1/32; E04C 3/38

[52] U.S. Cl. ..... 52/639; 52/642; 52/643; 52/644; 52/724.4; 52/737.3; 52/86; 14/12; 14/25

[58] Field of Search ..... 52/86, 87, 88, 52/85, 639, 640, 641, 642, 643, 644, 724.4, 731.1, 737.3; 14/12, 24, 25, 26

[56] References Cited

U.S. PATENT DOCUMENTS

| | | | |
|---|---|---|---|
| 401,870 | 4/1889 | Wells | 52/642 |
| 1,346,229 | 7/1920 | Mecham | 52/642 |
| 1,438,452 | 12/1922 | Miller | 52/642 |
| 1,542,919 | 6/1925 | Summerbell | 52/642 |
| 1,687,850 | 10/1928 | Shodron | 52/86 |
| 1,753,862 | 4/1930 | Johnson | 52/642 |
| 2,390,418 | 12/1945 | Brown | 52/86 |
| 2,612,854 | 10/1952 | Fuge | 52/86 |
| 2,666,507 | 1/1954 | Ruark | 52/643 |
| 2,770,846 | 11/1956 | Findleton | 52/642 |
| 3,439,107 | 4/1969 | Scott | 52/86 X |
| 3,530,623 | 9/1970 | Burton | 52/86 |
| 4,112,694 | 9/1978 | Gruber | 52/640 X |
| 4,173,857 | 11/1979 | Kosaka | 52/642 |
| 4,441,287 | 4/1984 | Muir | 52/642 X |

FOREIGN PATENT DOCUMENTS

| | | | |
|---|---|---|---|
| 1142644 | 9/1957 | France | 52/639 |

*Primary Examiner*—Wynn E. Wood
*Assistant Examiner*—Laura A. Saladino

[57] ABSTRACT

A biarch consists of two coplanar arches, curved in the same direction and radially spaced with cross ties having shear rigidity in planes perpendicular to the cross section areal center curve of the arch pair. End ties resist relative tangential arch displacements. Biarch framing members are strong, stiff, durable and economical structural members for framing aesthetically pleasing, clear span arched structures capable of withstanding hurricane winds and mountain snows. The most efficient materials for constructing biarch framing members are hardwoods, aluminum and steel. Biarch frames spanning up to fifty feet can be assembled or disassembled by one or two persons using common hand tools.

26 Claims, 6 Drawing Sheets

BIARCH-FRAMING MEMBER FOR ARCHED STRUCTURES

BACKGROUND OF THE INVENTION

1. Fields of the Invention

The present invention pertains to arched buildings and roofs. More directly, it relates to the skeletal arched frameworks which must resist the high and variable wind and snow loads such arched structures are exposed to.

Historically, arched structures have been large bridges and buildings for public uses such as auditoriums and sports arenas. These structures have large spans and arch shapes which are close to the funicular shape for the dead load. An open-web steel arch bridge spans 1,652 feet at Bayonne, N.J. (Ref. 1, *McGraw-Hill Encyclopedia of Science & Technology,* 7th Ed., 1992, pg. 50). A reinforced concrete arched vault spans 262 feet in the Turin Exhibition Hall (Ref. 2, Luigi Nervi, *Aesthetics and Technology in Building,* Harvard University Press, Cambridge, Mass., 1965). Laminated wood arched structures have spans over 200 feet, with monolithic three-hinged arches (Ref. 1, pg. 51) and over 500 feet as a lamella dome in Tacoma, Wash. (Ref. 3, *Wood Handbook: Wood as an Engineering Material,* Agriculture Handbook 72, Forest Service, USDA, 1987, pg. 10-4).

This invention relates to open-web arches which may be freely shaped to meet aesthetic and functional ends, independent of building site and resulting live loads. Such arches have non-funicular shapes and are primarily stressed by internal bending moments resulting from structure live loads of wind and snow. They will primarily be used in residential structures having clear spans less than fifty feet.

2. Description of the Related Art

Nine U.S. Patents have been found which disclose compound arched structures composed of two or more arches which are spaced apart in directions radial to their common cross section areal centroid curve and connected by a set of sturctural parts. Four of the older inventions (1889–1944) used wooden arches and four of the later ones (1942–1970) used structural steel arches. One (1969), an arched tower of approximately funicular shape rather than a moment resisting structure frame, used glass reinforced plastic arches, for their electrical and structural properties.

The relevance of these open-web arched structures to the present invention can best be seen by first considering the function of a straight, transversely loaded beam. Assume a horizontal beam is loaded vertically downward in its depth direction. The top half of the beam is compressed and tends to shorten. The lower half tends to lengthen under tensile stress. The middle part of the beam develops shear stress to resist relative longitudinal sliding between the top and bottom beam halves. Shear stress and strain in the longitudinal and depth directions produce tensile and compressive stress and strain in directions having acute angles of plus and minus 45° to the longitudinal beam axis. For this reason, the mid-depth portion of a monolithic beam can be replaced by diagonal bars inclined at or near 45° to the beam axis. Such open-web beams are common in steel joist and wood trusses for both floors and flat roofs.

The essential structural requirement for the mid-depth portion of a transversely loaded straight beam is that it have shear rigidity in planes parallel to the beams longitudinal axis and applied loads, which are usually close to coplanar. Further, this shear rigidity must exist over the full length of the beam. It can be provided by the full width of a monolithic wood beam, by the relatively thin web of a steel I beam, or by the diagonal web bars of an open-web steel joist or wood truss. All provide shear rigidity in the coplane of the beams long axis and transverse loads.

Historically, it has been assumed that this requirement for shear rigidity in the plane of the beam's long axis and applied loads and over the beam's full length was also a requirement for curved beams or arches. All eight of the prior-art U.S. patents relating to non-funicular, moment resisting, open-web arches provide arch connecting means which have shear rigidity in the plane containing the cross section areal centroid curve of the arch and they provide it over the full length of the open-web arch.

Open-web wood arches were disclosed in U.S. Pat. No. 401,870, having webs of radial posts and diagonal braces; U.S. Pat. No. 1,438,452, had double bolted and keyed blocks for web connectors over most of the arch length and diagonal braces near the arch ends; U.S. Pat. No. 1,687,850, used one of two shear web means, double bolted tapered blocks, or a diagonal metal tension strap over radial spacing sleeves and bolts, referred to as a tension and shear member; U.S. Pat. No. 2,390,418, used double bolted blocks spaced uniformly over the full length.

Open-web steel arches were disclosed in U.S. Pat. No. 2,278,797, with diagonal web parts welded to arched channels over the full arch length, with the addition of radial web parts and cross braces near the springing of the arch; U.S. Pat. No. 2,612,854, had diagonal bars or braces welded to arched channels; U.S. Pat. No. 2,666,507, provided spacer plates, which were coplanar with the arches cross section areal centroid curve, welded to steel arches of preferably circular cross section; U.S. Pat. No. 3,530,623, had short, transverse truss braces of hollow square cross section welded to steel channels in and near their curved lengths.

U.S. Pat. No. 3,439,107 disclosed an arch shaped electrical transmission tower made from four support rods of arched shape and transverse spacer rods. It appeard to be an intuitive attempt to provide a funicular shape for both the tower and the individual arches so that they were subjected to primarily longitudinal stresses with small bending stresses. Spacer rods obviously spaced the support rods relative to each other and also shortened their buckling length, though there was no discussion of either funicular shape or buckling.

3. Present Needs

There was no discussion in the reviewed art of open-web arches concerning their buckling characteristics. Some were obviously not self-stable against excessive buckling type rotations and lateral deflections under compressive end loading. The leeward arch is subjected to such compressive buckling loads from wind in the arch span direction. All except U.S. Pat. No. 3,439,107 were intended to have purlins or cladding attached to the outside arch in the direction of arch width. In addition, U.S. Pat. Nos. 2,666,507 and 2,390,418 both provided purlins or stringers, in the arch width direction, through the web volume. Lateral support of the open-web arch by attached structural members, such as purlins, stringers and cladding, can significantly reduce arch buckling rotation about its areal centroid curve and lateral buckling deflections in the arch width direction. That is often a partial purpose.

The recent availability of transparent architectural glazing panels of UV light durable polycarbonate and acrylic plastics in four and six foot widths and continuous lengths, makes possible the continuous glazing from base to ridge of an arch framed structure. It is often desirable that this continuous glazing not be interrupted by horizontal purlins or glazing bars for visual and aesthetic reasons and for minimizing horizontal weather seals. Due to the high coefficients of thermal expansion, these plastic glazing panels are not directly connected to the outside arches, but are free to slide between weather seals. Therefore, they provide little or no lateral support for the arched framing members, which must be self supporting against excessive buckling rotations and deflections over their full length from base to structure ridge. This requirement for open-web arches for small span structures which are self-stable under compressive buckling loads is a recent one, resulting from the availability of large plastic glazing panels.

The open-web arches of the prior-art were not aesthetically pleasing and were intended for agricultural, industrial and commercial uses. Arched shapes are inherently pleasing, but the cluttered nature of numerous across web connectors dominate their appearance. Also, open-web wood arches predated the availability of water durable structural adhesives and were "laminated" with bolts and spikes. The welded structural steel open-web arches would have been hot dipped galvanized, painted or used bare. Consequently, there exists a present need for aesthetically pleasing open-web arches.

Any new open-web arch that provides buckling self-stability and a pleasing appearance must also economically provide for an arch depth which varies over the arch length, as does the distribution of internal bending moments under worst-case wind and/or snow loading. Four of the older prior-art patents did not. Four of the newer did.

There is also an increasing need for greater structural efficiency, i.e. providing structures which are sufficiently strong and stiff, but with less structural material. This requires greater arch depth to resist the load moments, with acceptable deflections and less arch material and greater arch width for buckling self-stability.

Much of the turn-key cost of a residential structure is for construction. There is a need for manufactured arched framing members which can be assembled into an arched structure by one or two lay persons using common hand tools and equipment.

SUMMARY OF THE INVENTION

It is an important object of the present invention to provide arched framing members capable of resisting large internal bending moments with acceptable deflections to permit the arch shape to be determined primarily for structure functional and aesthetic reasons rather than primarily for worst-case structure loads. The primacy of functional and aesthetic qualities result in arches of decidedly non-funicular shapes.

It is another important object of the present invention to provide arched framing members which, despite their non-funicular shapes, are strong enough to withstand hurricane winds and mountain snows and stiff enough to meet the standard span/deflection requirements with a minimum of structural material.

In particular, it is an object to provide open-web type arched framing members for arched structures having clear spans generally less than fifty feet for residential type structures.

It is also an object of the present invention to provide arched framing members with high structural efficiencies to conserve structural materials such as renewable wood resources, aluminum and steel.

Another important object according to the present invention is to provide arched framing members which are self-stable against both rotational buckling about the arch cross section areal centroid curve and lateral buckling in the direction of the arch width, without lateral support from other structural members.

A further object is for the arched framing members to facilitate structures having a high percentage of glazed exterior surface, with a minimum of visual obstructions, for providing abundant natural light and exceptional exterior views.

To enhance the above object, it is a further object of this invention to provide arched framing members which facilitate structures with high thermal efficiencies to minimized heating and cooling costs.

It is also an object to provide arched framing members which facilitate air venting and the distribution of utility ducts, pipes and lines throughout the structure.

Another important object of the present invention is to provide arched framing members which are aesthetically pleasing in themselves and in arched structures.

It is a further object to provide open-web arches having a minimum number and size of connectors across the web volume of the arch.

A further important object of this invention is to provide arched framing members which are durable in structures having warm, moist interior environments, such as greenhouses and enclosed swimming pools.

It is an important object of this invention to provide framing members which can be assembled into arched structures, having clear spans up to fifty feet, by one or two lay persons using common hand tools and equipment.

Another important object according to the present invention is to provide framing members for advanced arched structures which have turn-key costs similar to conventional residential construction.

These and other objects which will become apparent from studying the appended description and drawings are provided in a biarch framing member for arched structures, comprising:

a pair of coplanar arches curved in the same direction over at least a portion of the length of their common areal centroid curve, each of said arches having a nearly constant width over said similarly curved length portion; and a pair of RT ties, spaced apart along said common centroid curve length, each of said RT ties, including its arch connecting means, having sufficient tensile and compressive rigidity, in the direction radial to said centroid curve at the location of said each RT tie, to resist relative displacement between said arches in said radial direction, and also having sufficient shear rigidity in its radial-tangential plane to resist relative displacement between said arches in the direction tangential to said centroid curve at said each RT tie location, at least one of said RT tie pair spacing said arches apart in said radial direction at the location of said least one RT tie; and at least one RW tie connecting said arch pair in said similarly curved length portion at a location between said RT tie locations and spacing said arches apart in the direction radial to said centroid curve at said RW tie location, said RW tie, including its arch connection means, having sufficient tensile and compressive rigidity in said radial direction to resist relative displacement between said arches in said radial direction, but having considerably less shear rigidity in its radial-tangential plane than the one of said pair of RT ties having the greater shear rigidity in its said radial-tangential plane.

One embodiment of the present invention divides at least one arch of the arch pair into two or more sub-arches and spreads them apart in the width direction to increase the buckling resistance of the biarch framing member.

Another embodiment replaces at least one of the end ties by rigidly attaching one or both of the biarch ends to adjacent structural member/s having shear rigidity in plane/s parallel to the coplane of the biarch framing member.

As will be seen, the present invention provides novel means for obtaining open-web arches of non-funicular shape which can be shaped to meet the functional and aesthetic requirements of small-span, low-rise arched structures which are strong and stiff enough to withstand extreme wind and snow loadings.

This invention derived from both theoretical and experimental work which showed the prior assumption, that curved beams or arches needed shear rigidity in the plane of the arch areal centroid curve and over the full curved arch length, was not realistic. It was discovered that arches need shear rigidity in the coplane of the arch centroid curve only near the arch ends. Throughout the curved length, the mid-depth portion of the arch can be mostly open, with the cross-web connectors having shear rigidity only in planes perpendicular to the arch centroid curve.

It was also discovered that this transverse shear rigidity not only gave open-web arches strength and stiffness against internal bending moments in the arch coplane, but also against buckling type rotations about the centroid curve and lateral deflections normal to the arch coplane.

Transverse cross ties of minimum size, variable spacing and minimum number provide large and variable arch depth to withstand large and variable internal bending moments with a minimum of structural material. Biarch framing members are structurally efficient in spite of their non-funicular shape and resulting large internal bending moments.

These transverse cross ties also provide means for spacing sub-arches in the width direction and limiting buckling type rotations and translations without support from lateral structural members. Buckling self-stability permits glazing nearly all of the exterior structure surface to achieve abundant natural light inside and occupant views of the outside environment with a minimum of visual obstructions.

Arched structures having high thermal efficiencies, even with high percentages of glazed exterior surface, are provided with biarch framing members with continuously curved interior arches to support sliding insulation and low emissivity solar shades.

Radially spaced arches and laterally spaced sub-arches provide a continuously interconnected space useful for distribution, throughout the arched structure, of utilities such as ventilation air, centrally conditioned air (heated, cooled, cleaned and/or humidified), electrical power, communication lines (phone, cable and antenna), water and gas lines.

Limiting the web parts to a few transverse cross ties and two parallel end ties limits the visual obstructions seen on profile views of biarch framing members, thereby preserving the aesthetic qualities inherent in arches having smooth, continuous and generally variable radii of curvature. Biarch framing members will often be open and visible to structure occupants as will the structure profile viewed externally. Naturally finished hardwoods, corrosion resistant aluminum and stainless steel add to the aesthetic appeal of open-web arches made according to the present invention. Such aesthetically pleasing biarch framing members can also be made very durable in warm, moist environments common to sunspace structures such as greenhouses and swimming pool enclosures.

Sub-dividing and laterally spacing a pair of radially spaced arches according to the present invention produces four sub-arches which are light enough in weight to permit one or two lay persons to assemble arched structures having clear spans up to fifty feet using common hand tools and equipment. This permits direct sales and shipment to owners and minimizes manufacturing, sales, distribution and construction costs. Reversible, threaded connectors permit disassembly and compact shipment for future portability of biarch framed structures.

BRIEF DESCRIPTION OF THE DRAWINGS

In the drawings wherein like elements are referenced alike:

FIG. 2 will be used to describe how biarch framing members develop internal tangential arch stress and bending moments in reaction to externally applied loads. More importantly, FIG. 2 will illustrate why the across web connectors need shear rigidity in planes parallel with the plane of the biarch centroid curve only at the ends of the arches and not throughout the biarch length, as is necessary in straight beams;

FIG. 3 will be used to develop equations for biarch bending stress and normal stress;

FIG. 4 illustrates what materials are most appropriate for constructing biarch framing members. Optimum biarch materials change with the span/deflection requirements of the sturcture.

FIG. 5 will be used to determine the biarch characteristics which are required for self-stability against excess buckling rotations and deflections and an expression for arch buckling stress due to buckling moment;

FIG. 7 will be used to develop equations for the cross tie spacings along the two arch centroid curves, arch bending stresses which depend on cross tie spacings and arch shear stresses due to cross tie and end tie forces.

DETAILED DESCRIPTION OF PREFERRED EMBODIMENTS

1. Biarch Description

Figures 1, 2:
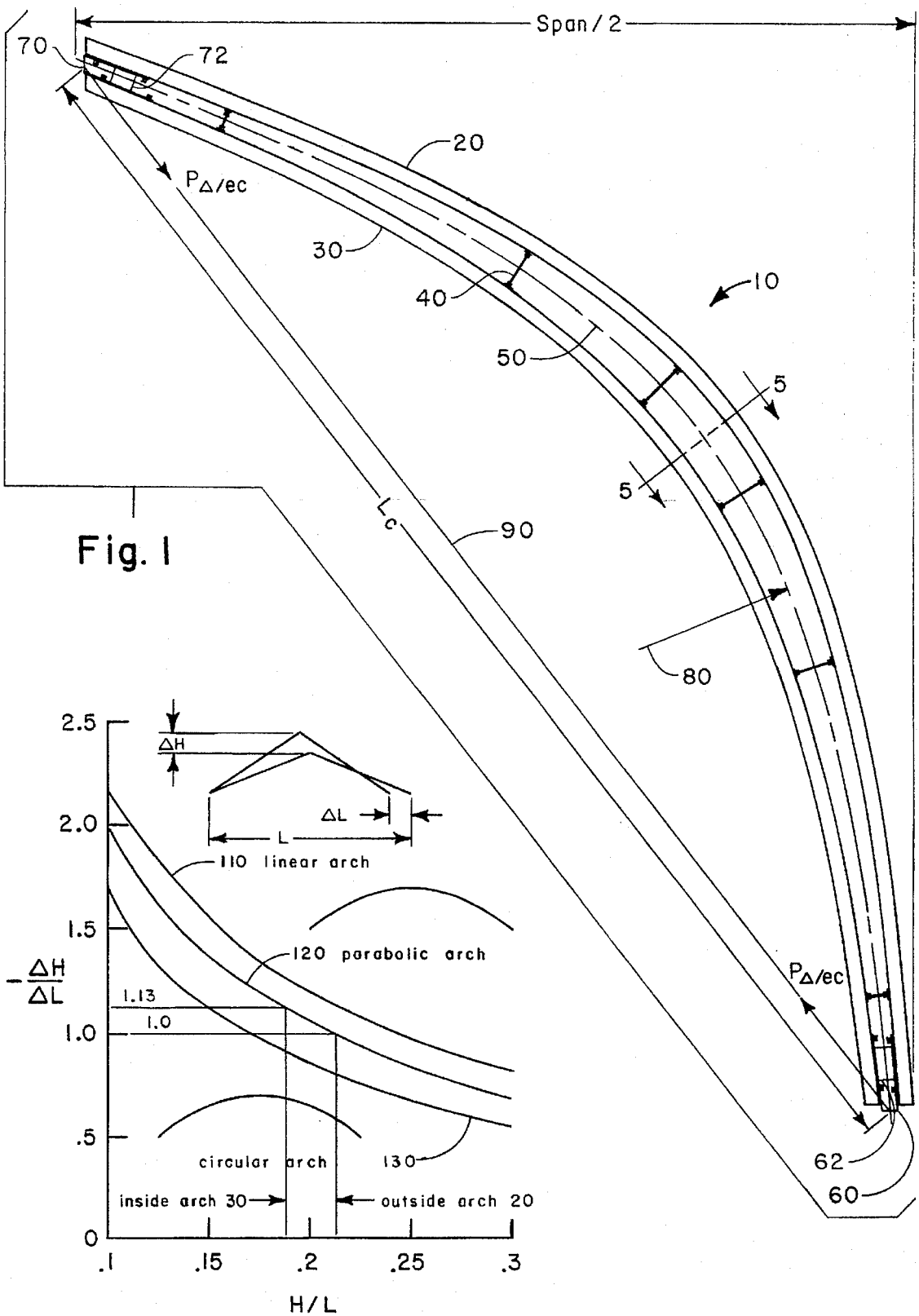
FIG. 1 is a front elevation view of a biarch framing member positioned to serve as one half of a frame spanning the width of an arched structure.
FIG. 2 is a graphical representation showing the rate at which arch height varies with change in chord length, as a function of the ratio of arch height to chord length, for arches of three different shapes, linear, parabolic and circular.

A biarch framing member consists of three essential components: a pair of coplanar arches, transverse cross ties and two parallel end ties, all illustrated in FIG. 1.

A front elevation view of a biarch framing member, generally indicated at 10 in FIG. 1, has a pair of coplanar arches, outside arch 20 and inside arch 30 curved in the same direction and spaced apart and connected by six cross ties 40, which have shear rigidity in planes which are perpendicular to biarch centroid curve 50. In general, the spacing of cross ties 40, along the curved length of centroid curve 50, will increase with its variable radius of curvature 80. The ends of arches 20 and 30 are connected by base end tie 60 and ridge end tie 70, both of which have shear rigidity in planes parallel to the plane of biarch centroid curve 50.

Compressive forces $P_{\Delta lee}$ acting along chord line 90 are the simplest means of loading biarch 10 to illustrate and describe its function as a framing member in arched structures subjected to worst-case loading by wind and/or snow.

Figure 5:
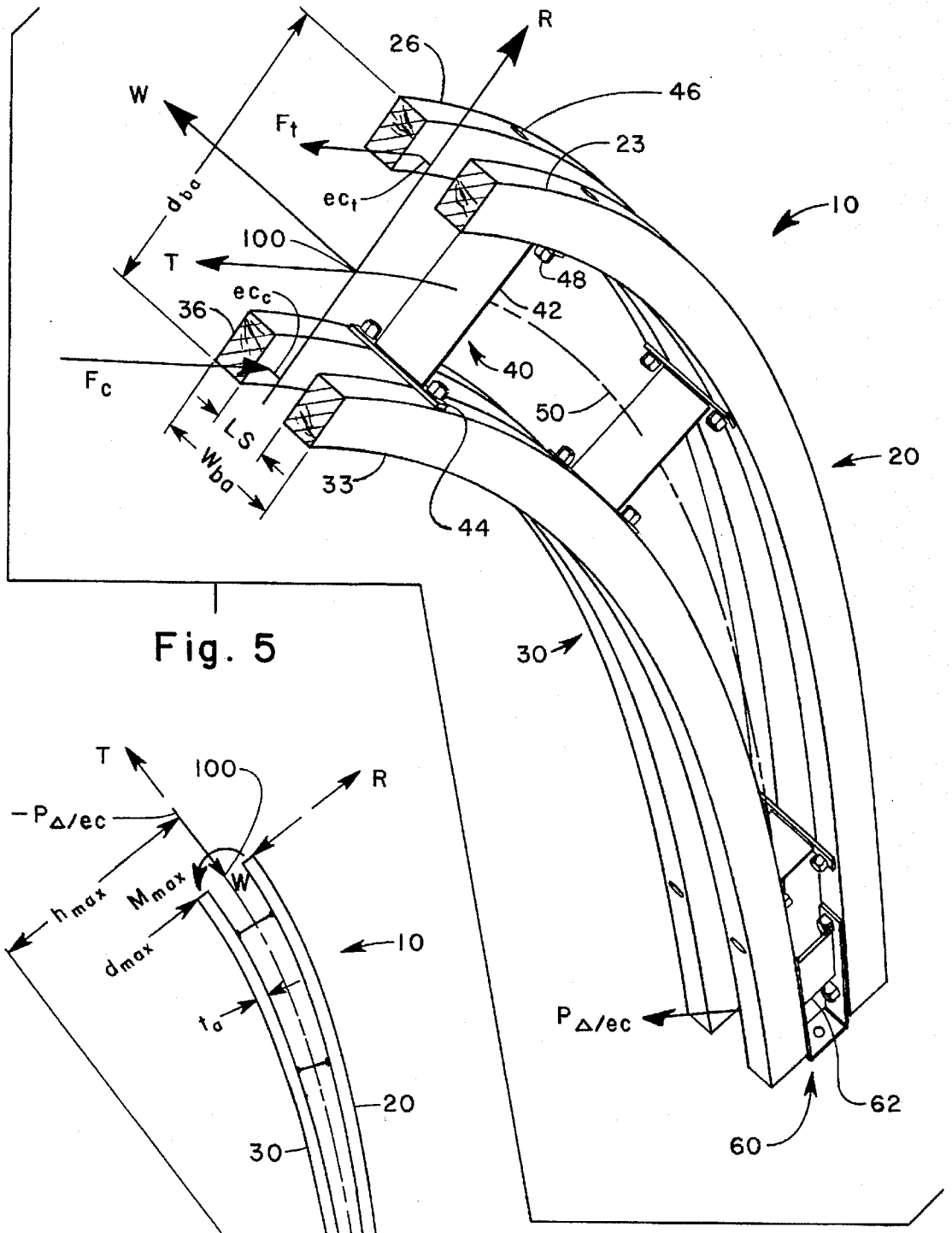
FIG. 5 is a perspective view of the lower part of the biarch framing member shown complete in FIG. 1. Eccentricity of internal reaction forces are shown, which produce rotational and translational buckling deflections of the biarch framing member.

When biarch 10 is sectioned by a plane 5—5 normal to centroid curve 50, through the point of its minimum radius of curvature, the lower portion of biarch 10 would appear in perspective as illustrated in FIG. 5. A right-handed coordinate system TRW is centered at point 100, with radial axis R and width axis W lying in the plane of cross section 5—5 of FIG. 1 and tangent axis T, normal to the plane of cross section 5—5 and tangent to centroid curve 50 at its point of intersection lee by plane 5—5.

Outside arch 20 has been divided into two halves of equal cross section area, forming half arches 23 and 26. Similarly, inside arch 30 consists of half arches 33 and 36. These half arches are spaced apart in the width direction to limit lateral biarch deflection in the width direction, which results when base force $P_{\Delta lee}$ produces reaction forces $F_c$ and $F_t$ which are eccentric to axis R by eccentric distances $e_c$ and $ec_t$, respectively.

Cross ties 40 are made of a structural steel plate 42, positioned normal to centroid curve 50, with welded end bars 44 drilled to receive countersunk bolts 46, through the center of the half arches in their depth direction. Nuts 48 secure the half arches to the cross ties. Because biarch depth $d_{bn}$ varies along the length of centroid curve 50, planes of end bars 44, which are flat against the inside surface of the half arches, are not quite perpendicular to plates 42. Through bolts 46, with axes perpendicular to the plane of end bars 44, are not quite radial to centroid curve 50. When nuts 48 are tightened, the four half arches are secured together by cross ties 40, which have shear rigidity in planes normal to the biarch centroid curve 50, thereby resisting relative displacements between arches 20 and 30 in both the radial and width directions at the location of each cross tie 40.

Because arches 20 and 30 are divided into equal halves, end ties 60 and 70 are also divided into two similar parts. Half of base tie 60 is connected to half arches 23 and 33, with the other half connected to half arches 26 and 36. Both halves of base tie 60 have welded shear plates 62, which are parallel with the plane of biarch centroid curve 50. These shear plates 62 resist relative displacements between adjacent base ends of arches 20 and 30, in the tangential direction of biarch centroid curve 50, at the base.

When biarch 10 is in use as a member of a frame of an arched structure, both halves of base tie 60 would be bolted to a concrete slab, foundation, wall, floor or other rigid base. If such a base has shear rigidity in planes parallel with the plane of biarch centroid curve 50, shear plates 62 of base tie 60 could be eliminated and all four half arches, 23, 26, 33 and 36 connected directly to the rigid base.

Ridge tie 70 in FIG. 1 is similar to base tie 60, being in two similar halves and having shear plates 72 which are parallel to the plane of centroid curve 50. However, in a typical structure frame, ridge tie 70 would be bolted to a ridge beam running the length of the structure. Such a ridge beam is usually relatively free to rotate about its longitudinal axis. Such rotation would permit relative tangential displacement between adjacent ridge ends of arches 20 and 30, if they were connected individually to the ridge beam. Therefore, ridge tie 70 with shear plates 72, which are parallel with the plane of biarch centroid curve 50, must generally be retained as an integral part of biarch framing member 10.

Relative tangential displacement between adjacent ends of arches 20 and 30 must be rigidly resisted at both ends of biarch 10 for it to reach its maximum structural stiffness. This requires shear rigidity in planes which are parallel with that of the biarch centroid curve 50. Such shear rigidity must be provided by components of the biarch framing member, such as end ties 60 and 70 or by the structure members to which the ends of arches 20 and 30 are attached.

2. Biarch Structures

In general, biarch framing members will be used as the primary structural members in the skeletal frameworks for private-use arched buildings having clear spans of less than fifty feet. Biarch framed structures will provide clear spans for unrestricted use of the interior space, vaulted ceilings for large overhead volumes and a high percentage of glazed exterior surface for abundant natural light.

A typical frame for an arched structure would use two of biarch framing members 10 in FIG. 1. Base end ties 60 would be bolted to a rectangular concrete slab floor near its sides. Ridge end ties 70, bolted to a ridge beam, would complete one frame spanning the full building width. A number of these two member biarch frames spaced in parallel vertical planes uniformly along the building length would form the primary skeletal frame for a biarched framed structure.

Architectural glazing materials such as glass and rigid transparent plastic panels of acrylic or polycarbonate and opaque exterior cladding materials can be attached to and supported by the outside arches of the biarch framing members. Insulation and interior wall/ceiling materials can be attached to and supported by the inside arches of the biarch framing members. The space between the arches can be vented to control moisture condensation on the inside surfaces of exterior cladding materials. This interarch space will also be useful for ventilation air and distributing electrical power, centrally conditioned air, communication lines, water and gas lines throughout biarch framed structures.

3. Biarch Function

The means by which a biarch framing member acts as a unit to resist deformation under applied loads can be understood by considering FIGS. 1 and 2.

Imagine that all six of the cross ties 40 are removed from biarch 10 in FIG. 1 before compressive forces $P_{\Delta lee}$ are applied along chord line 90. Then as $P_{\Delta lec}$ are applied, chord length $L_c$ will decrease. Outside arch 20 and inside arch 30 will both move outward, increasing their perpendicular distance from chord line 90. However, both arches will not move outward at the same rate. For a given incremental decrease in $L_c$, inside arch 30 will move outward further than will outside arch 20. Thus, the radial distances between the two arches will decrease. Conversely, if the forces $P_{\Delta lec}$ are reversed in direction and applied as tensile forces, $L_c$ would increase, the inside arch 30 would move towards chord line 90 at a faster rate than outside arch 20 and the two arches would move further apart.

The primary purpose of cross ties 40 is to prevent relative displacements between the arch pair 20 and 30 in directions radial to centroid curve 50. When biarch cross ties 40 are in place, as illustrated in FIG. 1, compressive forces acting along chord line 90 load cross ties 40 in compression as they resist the tendency for arches 20 and 30 to move closer together. Conversely, tensile forces along chord line 90 load cross ties in tension as they resist the tendency for arches 20 and 30 to move farther apart.

Figures 8, 9, 10:
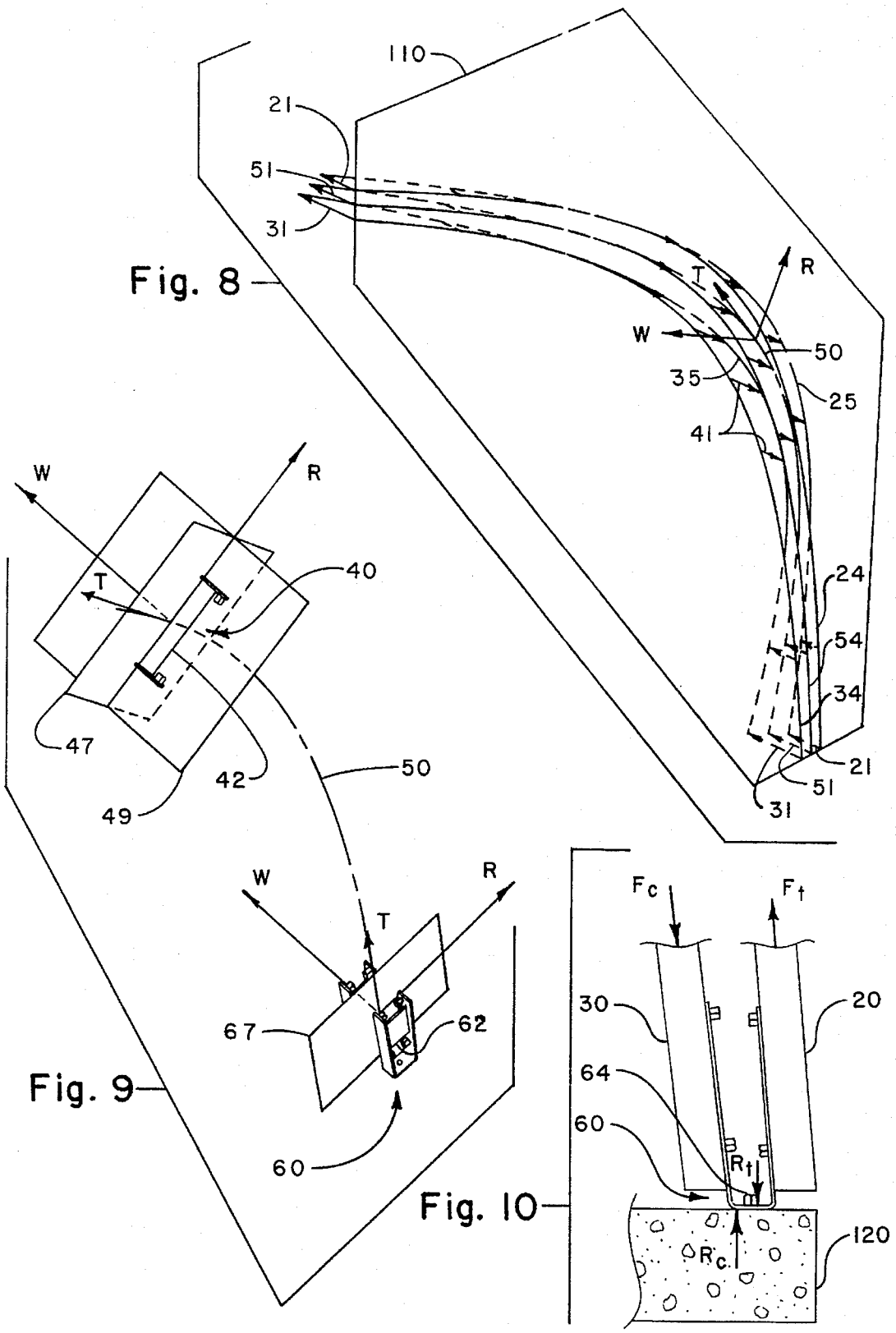
FIG. 8 shows a hypothetical coplane of the biarch framing member illustrated in FIG. 1. Also shown are the cross section areal centroid curves of each arch and the common cross section areal centroid curve of the biarch and their normal projections onto the biarch coplane. Root-mean-square distances of the three centroid curves from the biarch coplane are also shown, greatly exaggerated for clarity.
FIG. 9 shows a transverse RW cross tie, a parallel RT end tie and the biarch centroid curve taken from the lower part of the biarch framing member as illustrated in FIG. 5. RWT axes are located at each tie. The radial-tangential and radial-width planes where radial and shear rigidity is important or requires discussion are also illustrated in FIG. 9.
FIG. 10 shows that the required shear rigidity of a parallel end tie can be provided by an adjacent structural member such as a concrete slab.

FIG. 9 is the same view of the lower part of biarch framing member 10 as is shown in FIG. 5 with every item removed except for one cross tie 40, end tie 60 and biarch centroid curve 50. Additionally, FIG. 9 shows an RWT coordinate axes, with the origin located on centroid curve 50 at the location of cross tie 40, assumed near the center of shear plate 42. Plane 49 contains radial axis R and width axis W. The plane of shear plate 42 parallels radial-width plane 49. Cross tie 40 and its arch connecting means must have sufficient tensile and compressive rigidity in the radial direction in RW plane 49 to resist relative displacement between inside arch 30 and outside arch 20, both shown in FIG. 5, in the radial direction R.

Finally, the radial forces produced in the cross ties stress the arches in tangential directions. Compressive chord line forces produce compressive cross tie forces which stress outside arch 20 in tension and inside arch 30 in compression. Tangential tensile stress in outside arch 20 and tangential compressive stress in inside arch 30 produce internal bending moments which balance those produced by applied end compressive forces $P_{L\Delta ec}$. These tangential arch stresses of opposite direction are transmitted to the arch ends where they tend to produce relative tangential displacement between adjacent ends of arches 20 and 30, which are resisted by end ties 60 and 70, both of which have shear rigidity in planes parallel to the plane of biarch centroid curve 50.

FIG. 9 also shows a RWT coordinate axes, with the origin located on centroid curve 50 at the location of end tie 60, assumed near a line connecting the mass centroids of shear plates 62. Plane 67 contains radial axis R and tangential axis T. The planes of shear plates 62 parallel radial-tangential plane 67. End tie 60 and its arch connecting means must have sufficient shear rigidity in its RT plane 67 to resist relative displacement between inside arch 30 and outside arch 20, both shown in FIG. 5, in tangential direction T. End tie 60 must also have sufficient tensile and compressive rigidity in radial direction R to resist relative displacement between arches 20 and 30 in radial direction R.

The process described above has been quantified in FIG. 2 for three arch shapes: linear, with infinite radius of curvature and a sharp bend; parabolic, with continuously varying radii of curvature; circular, with a constant radius of curvature. It is interesting that curve 120 for a parabolic arch of variable curvature lies between curve 130 for a circular arch of constant curvature and curve 110 for a linear arch of zero curvature, except for the sharp bend. The arches 20 and 30 in biarch 10 of FIG. 1 are hyperbolic in shape with continuously varying radius of curvature, similar to the parabolic arch shape which produced curve 120 in FIG. 2.

Outside arch 20 of biarch 10 in FIG. 1 has a larger H/L and a smaller —ΔH/ΔL than does inside arch 30. Appropriate lines for arches 20 and 30 have been drawn on FIG. 2. An incremental change of one inch in chord length $L_c$ would tend to change the length of the larger cross ties 40 near section plane 5—5 by 0.13 inches. When this length change is resisted by rigid cross ties, tangential stresses of about 1800 psi would be produced in hardwood arches having an elastic modulus of 2E6 psi parallel to the grain of the wood.

Real cross ties are of course not perfectly rigid and permit some relative radial displacement between inside arch 20 and outside arch 30. However, the radial rigidity of cross ties 40 and their arch connecting means must be sufficiently large that their length change is small compared to the change in radial distance which would occur, 0.13 inches in the above example, in their absence, under the maximum permitted change in chord length $L_c$.

4. Biarch Strength and Stiffness

About half or more of the ultimate strain or stress capability of the arch pair of a biarch framing member is available to resist bending moments produced by structure loads. The remainder is needed to support large cross tie spacings, which lower costs and improve the appearance of biarch framing members, desired since they will be visible in many of the potential applications, and also needed for normal stress and buckling stress.

Figure 3:
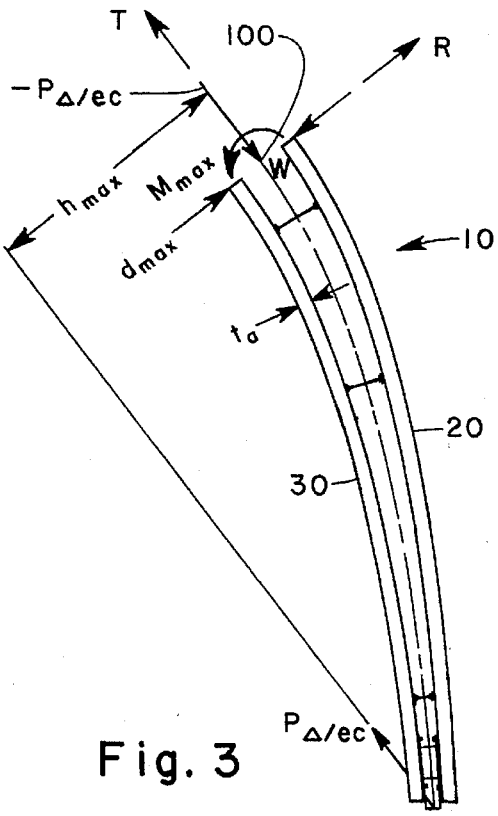
FIG. 3 is a free body diagram of the lower part of the biarch framing member, shown complete in FIG. 1. Internal reaction force and bending moment balance the applied compressive load.

The biarch bending stress which results from structure loads is readily derived by considering the lower part of biarch 10, FIG. 5, as a free body subjected to compressive load force $P_{\Delta lec}$, as illustrated in a front elevation view in FIG. 3. The dimension arrows for maximum biarch depth $d_{max}$ in FIG. 3 are coplanar with section plane 5—5 in FIG. 1 and the RW plane in FIG. 5.

The TRW coordinate axes are centered at point 100, with the positive width axis W into the plane of the FIG. 3. Assuming the lower part of biarch 10 is a free body, it must be stable under the influence of compressive load $P_{\Delta lec}$ and neither translate nor rotate. Therefore, a reaction force equal to $P_{\Delta lec}$ in magnitude and in opposite direction acts at point 100. Also, a counterclockwise bending moment $M_{max}$ acts in the plane of biarch centroid curve 50, about the W axis. Both are illustrated in FIG. 3. To prevent rotation, $$M_{max}=P_{\Delta ec}*h_{max}$$

where $h_{max}$ is the perpendicular distance between the parallel $P_{\Delta lec}$ forces.

The maximum bending stress in the arches of biarch 10 produced by biarch bending moment $M_{max}$ is, $$\sigma_{m\ max}=M_{max}*d_{max}/(2*I_{d\ max})$$

where, $I_{d\ max}$ is the maximum moment of inertia, or more properly the second moment of area, of arches 20 and 30 in the R, or biarch depth direction, with respect to the W axis. For solid laminated wood arches in FIGS. 3 and 5, $$I_{d\ max}=A_a*(d_{max}-t_a)^3/12$$

where, $A_a$ is the cross sectional area of each arch 20 and 30, less the projected area of the holes for through bolts 46 in FIG. 5. $t_a$ is the arch thickness in radial directional R. This equation also neglects the small contribution of the second moment of area of each arch, with respect to its own width axis.

The maximum normal stress on the cross section areas of arches 20 and 30, due to reaction force—$P_{\Delta/ec}$ centered at point 100 is, $$\sigma_{n\ max}=P_{\Delta/ec}/(2*A_a)$$

This stress will be used later to determine arch bending stress due to cross tie spacing.

The stiffness of biarch 10 in FIGS. 1, 3 and 5 can be quantified as a spring constant, the ratio of compressive load $P_{\Delta/ec}$ along chord line 90 in FIG. 1 to the resulting deflection $\Delta L_c$ along that line. The deflection of an arch may be computed from (Ref. 4, *Timber Construction Manual,* 3rd. ed., American Institute of Timber Construction, 1985, pg 5-256, eq. 5-74), $$\Delta L_c = L_{bacc}/(N*E)*\sum_{n=1}^{N} M_n*m_n/I_n$$

where: $\Delta L_c$ is the deflection along chord length $L_c$ resulting from compressive loads $P_{\Delta/ec}$;

$L_{bacc}$ is the curved length of biarch centroid curve 50;

N is the hypothetical number of equal length segments $L_{bacc}$ is divided into for computational purposes;

E is the elastic modulus of arches 20 and 30 in tangential directions;

$M_n$ is the biarch bending moment at positions n on centroid curve 50;

$I_n$ is the second moment of area, in the R direction, with respect to the W axis, of biarch 10 at positions n;

$m_n=1*h_n$ is a bending moment at positions n resulting from a hypothetical unit load applied at the location of and in the direction in which deflection $\Delta L_c$ is desired;

$h_a$ is the perpendicular distance from point n on biarch centroid curve 50 to chord line 90, along which $P_{\Delta/ec}$ acts.

The biarch stiffness is therefore, $$P_{\Delta/ec}/\Delta L_c = (E/L_{bacc})*\left(N/\sum_{n=1}^{N} h_n^2/I_n\right)$$

5. Fundamental Biarch Equation

The above equations for biarch stiffness $P_{\Delta ec}/\Delta L_c$ and bending moment stress $\sigma_{m\ max}$ can be combined to obtain a very useful expression governing the structural characteristics of biarch framing members.

$$d_{max}/h_{max}=BSF*e_{uit}*BSE*(span/deflection)$$

where: $d_{max}/h_{max}$ is the ratio of maximum biarch depth to maximum biarch height above chord line 90;

BSF is a biarch shape factor, $$BSF = (2/N)*\sum_{n=1}^{N} [(h_n/h_{max})^2/(I_n/I_{d\ max})]$$

$e_{uit}$ is the ultimate useful tangential strain capacity of biarch arches;

$BSE=e_{m\ max}/e_{uit}$, is the fraction of the ultimate useful arch strain used to resist the maximum biarch bending moment, produced by the worst-case loading. It serves as a quantitative measure of the structural efficiency of the biarch framing member design in resisting internal bending moments;

Span/deflection, the ratio of clear span to maximum allowable deflection of the biarch structure frame, approximately $L_{bacc}/L_c$;

BSF, the first term on the right side of the above equation has a value less than two, which depends of the shape of the biarch centroid curve and the radial distances of the arches from it. BSF equaled 1.357 for the hyperbolic shaped biarch 10 in FIG. 1.

The second term $e_{uit}$ is the ultimate useful strain of the arch material in tangential directions. Structural materials with ultimate use strains of 0.1% to 0.25% will be useful for biarch construction.

The third term $e_{m\ max}/e_{uit}$ can be considered a quantitative measure of the structural efficiency of a specific biarch design. It is the fraction of ultimate useful arch strain which goes to resist the maximum biarch bending moment which results from the worst-case loading of a biarch framed structure. It can be in the range 0.5 to 0.6 for hardwood arches in biarch framing members with generous cross tie spacings. It was slightly less than 0.5 for biarch 10 in FIG. 1.

The fourth term of the right is the ratio of clear span of a two member biarch frame to the maximum allowable frame deflection, which is approximately equal to $L_{bacc}/\Delta L_{c\ max}$ for worst-case wind and/or snow loading. This ratio, which has been determined from long structural experience, is usually specified in building codes.

The term on the left is the ratio of maximum biarch depth to maximum biarch height above the chord line from base to ridge, for a biarch framing member having specific arch shapes and resulting biarch shape factor, which can utilize arches with ultimate strain capacity $e_{uit}$ and meet a specified span/deflection requirement with a desired biarch structural efficiency, BSE. Lower $d_{max}/h_{max}$ ratios will lower biarch structural or increase maximum structural deflections or both. If it is desired to use the arch material selected more efficiently in support of structure loads and/or decrease structure deflections to meet a higher span/deflection requirement, $d_{max}/h_{max}$ will have to be increased. Alternately, the arch material may be changed or arch design and shape factor BSF modified.

Figure 4:
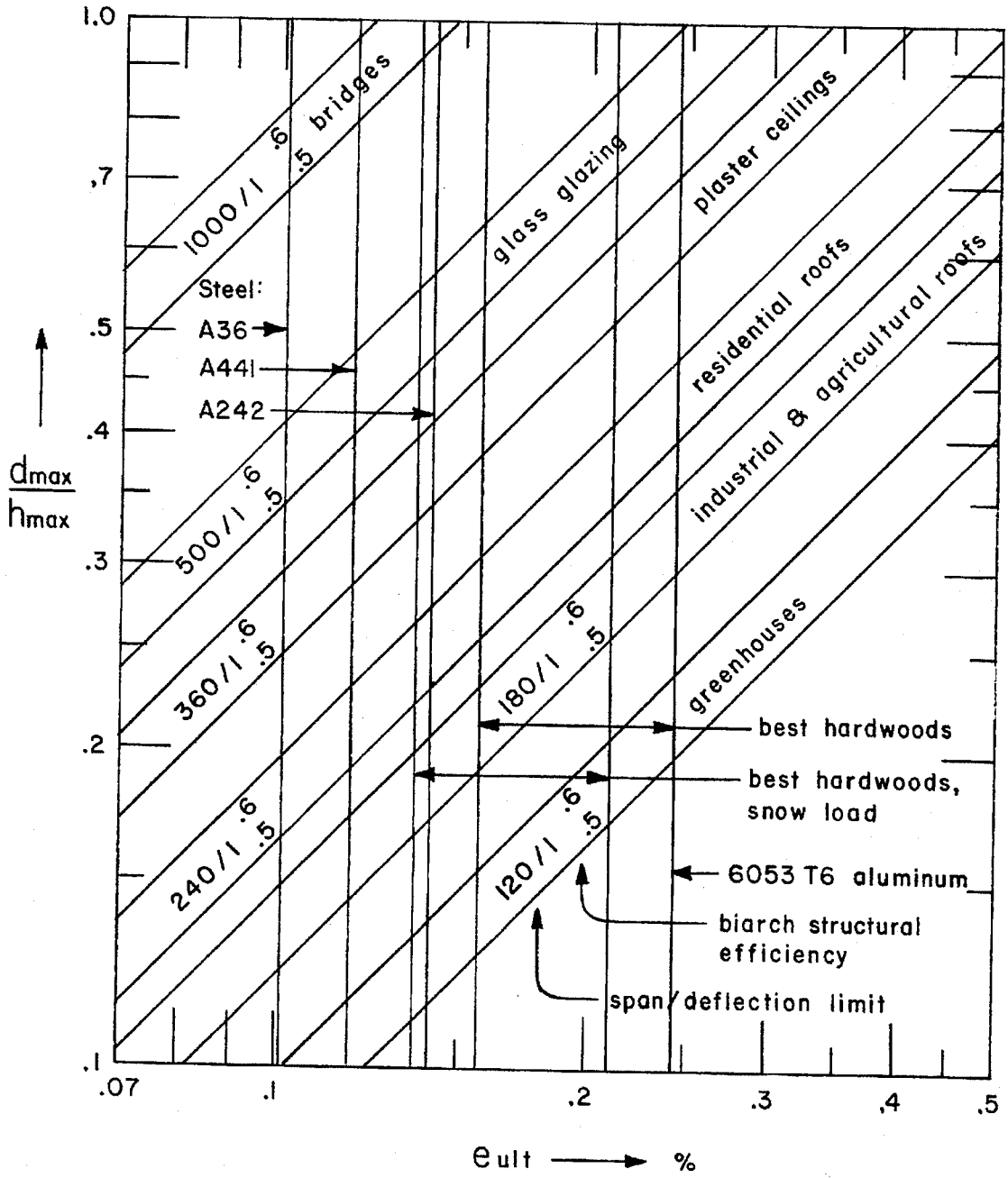
FIG. 4 is a graphical representation of the fundamental equation for the structural function of biarch framing members. The ratio of biarch maximum depth to maximum height above the chord line is shown as a function of arch strain capacity, structure span/deflection limit and biarch structural efficiency. Biarch shape factor is included as a constant.

The above fundamental equation for biarch structural framing members was used to determine what structural materials would be useful for arches in biarch frames and in what type of end-use structures. Using the biarch shape factor of 1.375, obtained for biarch 10, FIG. 1, $d_{max}/h_{max}$ was computed as a function of $e_{uit}$, with BSF span deflection limit and BSE as parameters. The results are illustrated in FIG. 4. As an example, arches with ultimate usable strain of 0.2%, used in a biarch design having an biarch structural efficiency of 50%, would meet a 240/1 span/deflection requirement with a $d_{max}/h_{max}$ of 0.325.

The ratio $d_{max}/h_{max}$ has optimum values in any specific arched structure. It is desired high for high biarch structural efficiency and stiff structures. It is desired low for high cross tie spacings, with resulting lower costs, and for the least intrusion of the inside arches into the interior structure volume. On the last point, if $d_{max}/h_{max}$ was two, the inside arches would be straight from base to ridge and the interior clear volume no greater than in a similar A-frame structure. For this reason alone, $d_{max}/h_{max}$ should be less than one, preferably less than 0.5.

6. Biarch Materials

The best arch materials for specific structure purposes can be determined from the above considerations and the computed values using the fundamental biarch equation, as illustrated in FIG. 4.

Structural steel would be the preferred arch material for biarch construction for stiff structures (span/deflection ratios of 500 and 360) with brittle cladding materials such as glass glazing or plaster ceilings.

Hardwood arches are preferred for residential roofs, span/deflection ratio of 240/1, where vaulted ceilings, abundant natural light, clear spans for unrestricted use of interior space and the aesthetic appeal of naturally finished hardwood and arched shapes are desirable characteristics.

Extruded sections of 6053 aluminum formed into arches for biarch construction would be useful in commercial and residential roofs where corrosion resistance is required.

Reinforced concrete with reinforcing steel having tensile yield strengths of 40,000 to 75,000 psi could meet any span/deflection requirement with reasonable ratios of biarch depth to height above the chord line.

A low cost arch material having maximum useful strains $e_{ult}$ in the range 0.3% to 0.5% and durable in wet environments would be useful for commercial greenhouses and agricultural arched structures.

In most cases, the arch material would also be used for the cross ties and end ties. Wood is an exception, due to its low usable shear strength across the grain, which is typically less than 10% of its usable bending strength parallel to the wood grain. To shear the full depth of a wooden arch, cross tie forces must bear on the top and the bottom surfaces of the arches. This is preferably done with steel bolts, through the arch depth to connect with steel cross ties as illustrated in FIGS. 1, 3 and 5. Wood cross ties bolted through the width of wood arches at mid-thickness with steel bolts and split ring timber connectors would require shorter cross tie spacings along the biarch centroid curve 50 and more cross ties. This may be acceptable where wood cross ties are desired for exceptional requirements.

7. Best North American Woods for Biarch Construction

The greatest use of biarch framing members will be in arched structures having span/deflection requirements of 240/1. Hardwoods have ultimate strain capacities in the direction of the wood grain which in 240/1 arched roofs require near optimum ratios of biarch depth to height, $d_{max}/h_{max}$, of 0.2 to 0.5.

While specific deflection limitations for arches have not been generally established (Ref. 4, pg 5-256), they are likely to be similar to those for present wood frame residential construction using wood truss roofs and stud walls. Maximum deflections, for structural members supporting roofs and exterior walls exposed to wind and/or snow loadings, of 1/240 of the span are recommended for residential structures (Ref. 5, The BOCA$^R$ National Building Code/1993, Building Officials & Code Administrators International, Inc).

Hurricane winds produce lift pressures on single story arched roofs of nearly 100 lbs/ft$^2$. Snow loads in some mountainous areas can be similar. The following criteria used to rank North American woods for use in biarch framing members capable of safely carrying these loads and meeting the span deflection requirements of applicable building codes:

1. High ratio of elastic modulus in bending E, lbs/in$^2$ to density ρ, lbs/in$^3$, for strong, stiff, light weight structures;

2. High strain at the proportional limit in compression parallel to the grain, $S_{cpgep1}/E$, since it is lower in compression than in bending. Average values for wood species (Ref. 6, L. J. Markwardt and T. R. C. Wilson, *Strength and Related Properties of Woods Grown in The United States,* Tech. Bulletin No. 479, Forest Products Laboratory, U.S.D.A., 1935) were reduced by a factor of 0.8 so that about 95% of the specimens of a species would have greater proportional limit stress values in compression parallel to the grain. This value was reduce further by 1/1.75 to obtain a value applicable for normal duration of load of ten years. This value, divided by E, was then increased by 1.33 to obtain the maximum usable strain in laminated wood biarch members when the worst-case loading is wind, $e_{max\ wind}$. The ten year strain value was increased by only 1.15, for worst-case snow load, $e_{max\ snow}$.

3. High shear strength parallel to the grain, $\tau_s$, for high biarch cross tie force and spacing. This value was also applied across the grain;

4. High compression stress, across the grain, at the proportional limit, $S_{cagep1}$, for small cross tie bearing areas.

A somewhat arbitrary product of the above wood properties was used to rank North American woods for use in biarch construction:

$$E/\rho*(S_{cpgep1}/E)*(\tau_s*S_{cagep1})^{0.5}$$

In addition to this property product, $e_{max\ wind}$ and $e_{max\ snow}$ are listed in the following table for the top 32 North American woods. The Rank is the above property product as a percentage of that for black locust, the best wood for biarch construction using these criteria.

TABLE

| Rank | Common Name | Scientific Name | $e_{max\ wind}$ | $e_{max\ snow}$ |
|---|---|---|---|---|
| 100 | Black Locust | *Robina pseudoacacia* | .2017 | .1744 |
| 85.3 | Persimmon | *Diospyros virginiana* | .1933 | .1671 |
| 84.3 | Blue Gum | *Eucalyptus globulus* | .2101 | .1817 |
| 77.5 | Blue Ash | *Fraxinus quadrangulata* | .2371 | .2050 |
| 77.3 | Canyon Live Oak | *Quercus chrysolepis* | .2307 | .1995 |
| 75.3 | Sugar Maple | *Acer saccarum* | .1791 | .1548 |
| 75.3 | Live Oak | *Querous virginiana* | .1572 | .1359 |
| 72.9 | Honeylocust | *Gleditsia triacanthos* | .1958 | .1693 |
| 72.3 | Sweet Birch | *Betula lenta* | .1774 | .1534 |
| 70.9 | Pacific Yew | *Taxus brevifolia* | .2130 | .1842 |
| 70.8 | Pecan | *Carya illinoensis* | .1820 | .1574 |
| 70.2 | Cherrybark Oak | *Querous falcata pagodifolia* | .1693 | .1464 |
| 70.2 | Biltmore Ash | *Fraxinus biltmoreana* | .2155 | .1863 |
| 69.0 | Green Ash | *Fraxinus pennsylvanica* | .1875 | .1621 |
| 68.4 | White Ash | *Fraximus americana* | .1989 | .1720 |
| 68.4 | Slash Pine | *Pinus elliottii* | .1854 | .1603 |
| 63.3 | Yellow Birch | *Betula alleghaniensis* | .1854 | .1603 |
| 62.1 | Pond Pine | *Pinus serotina* | .2189 | .1893 |
| 61.2 | Black Cherry | *Prunus serotina* | .2432 | .2103 |
| 60.7 | Longleaf Pine | *Pinus palustris* | .1879 | .1625 |
| 59.5 | Swamp White Oak | *Quercus bicolor* | .1729 | .1495 |
| 59.4 | Western Larch | *larix occidentalis* | .2116 | .1829 |
| 58.9 | Black Walnut | *Juglans nigra* | .2092 | .1809 |
| 58.6 | Douglas Fir, coast | *Pseudotsuga taxifolia* | .2043 | .1766 |
| 57.9 | Hophornbeam | *Ostrya virginiana* | .2067 | .1787 |
| 57.3 | Scarlet Oak | *Quercus coccinea* | .1767 | .1528 |
| 55.0 | Douglas Fir, inter. | *Pseudotsuga taxifolia* | .2054 | .1776 |
| 54.5 | Rock Elm | *Ulmus thomasii* | .1856 | .1604 |

TABLE-continued

| Rank | Common Name | Scientific Name | $e_{max\ wind}$ | $e_{max\ snow}$ |
|---|---|---|---|---|
| 54.4 | Port Orford Cedar | *Chamaecyparis lawsoniana* | .2070 | .1790 |
| 50.9 | Pin Oak | *Quercus palustris* | .1624 | .1404 |
| 48.9 | Shortleaf Pine | *Pinus echinata* | .1758 | .1520 |
| 48.7 | White Oak | *Quercus alba* | .1626 | .1406 |

In using the above strain limits for biarch design purposes, realistic safety factors must be considered and the hardwoods would have to be harvested and processed by species not just type, e.g., scarlet oak or pin oak, not red oak.

Many of the above woods will not be used for biarch construction, due to small size, limited supply or other more valuable uses. However, two of the best, black locust and honeylocust, have no other valuable commercial uses and would be better utilized for biarch construction. Also the hardest of the southern yellow pines, which are now used in wood frame construction, have good properties for arches in biarch framing members.

8. Biarch Buckling Resistance

When biarch 10 in FIG. 1 is loaded by compression forces $P_{\Delta/ec}$ along chord line 90, it not only bends in the plane of centroid curve 50 and deflects along chord line 90, it also deflects normal to this plane in the width direction. It may also rotate about tangents to centroid curve 50. These buckling type lateral deflections and rotations occur because centroid curve 50 is not perfectly planar and the compressive load forces $P_{\Delta/ec}$ are not coplanar with the centroid curve. The lateral distance eccentricities can be a significant fraction of the biarch width $W_{bn}$ in FIG. 5.

In practice, a hypothetical reference plane, for which the root-mean-square, rms, distance of the biarch centroid curve 50 from the reference plane is a minimum, can be considered the "coplane" of the biarch centroid curve. Biarch framing members, of specific design, manufacture and assembly in an arched structure, must have a rms distance of its centroid curve from its coplane which is less than some specified maximum distance, to be acceptable for use in its intended application.

FIG. 8 illustrates one example of the concept of biarch coplane used herein. Arch areal centroid curves 25 of outside arch 20 and 35 of inside arch 30 will almost never be perfectly planar, shown deviating from plane 110 by distance arrows 41 oriented perpendicular to plane 110. Biarch centroid curve 50 is the curve of centroid points of the combined areal cross sections of arches 20 and 30. The perpendicular projections of centroid curves 25, 35 and 50 onto plane 110 are shown as curves 24, 34 and 54, respectively. Behind coplane 110, these centroid curves are shown as dashed lines and in front of it as center lines. For simplicity, the perpendicular distance deviations, arrows 41, of all three centroid curves from coplane 110 were assumed as half periods of sine functions. End arrows 21 for centroid curve 25, 31 for centroid curve 35 and 51 for centroid curve 50 are the rms distances of the respective centroid curves from coplane 110. If the arch and biarch centroid curve shapes are assumed fixed and plane 110 was translated or rotated about any axis, the rms distance of biarch centroid curve 50 from plane 110 would increase. The orientation of plane 110 for which the rms distance of biarch centroid curve 50 from plane 110 is a minimum is herein considered to be the biarch coplane.

The required buckling characteristics of biarch framing members can be understood by considering the lower part of biarch 10 as illustrated in a perspective view in FIG. 5. Rotational buckling about centroid curve 50 will be considered first, followed by a quantitative determination of lateral buckling requirements.

Reaction forces $F_c$ and $F_t$, which are assumed normal to plane RW, are eccentric to axis R by distances $ec_c$ and $ec_t$, respectively. The eccentricity of internal reaction tensile force Ft produces a moment equal to $F_t{}^* ec_t$ which tends to deflect outside arch 20 in the negative W direction, towards the R axis. The moment of internal reaction compressive force $F_c$ times its eccentric distance $ec_c$ tends to move inside arch 30 in the positive W direction, further away from the R axis. Taken together, these two displacements are a shear displacement in the RW plane. If cross ties 40 have shear rigidity in RW planes, which are perpendicular to centroid curve 50, relative shear displacements between outside arch 20 and inside arch 30 will be resisted and the two arches will act as a unit, i.e. as a biarch, and tend to rotate in RW planes about tangents to centroid curve 50.

However, such rotational buckling is resisted by the polar moment of inertia, $$I_p = I_d + I_w$$

Lateral buckling, to be considered below, is controlled by $I_w$, the second moment of area, in the width direction W, with respect to the depth or radial axis R. $I_w$ of biarch 10 is constant over the length $L_{bacc}$ of centroid curve 50. Since $I_d$, which varies along $L_{bacc}$, is much greater than $I_w$, rotational buckling is much less than lateral buckling when cross ties 40 have shear rigidity in planes perpendicular to centroid curve 50. This is the second most important function of cross ties 40.

FIG. 9 shows cross tie 40 with its shear plate 42 essentially coplanar with its radial-width plane 49. These shear plates 42 and their arch connecting means, welded end bars 44, bolts 46 and nuts 48, all shown in FIG. 5, have sufficient shear rigidity in RW plane 49 to resist relative displacement in the width direction between inside arch 30 and outside arch 20.

The most important function of cross ties 40, to resist relative radial displacements between arches 20 and 30, requires cross tie rigidity in radial directions R. Their second most important function, to resist relative shear displacements in RW planes between arches 20 and 30, requires shear rigidity in those RW planes. Cross ties 40 must also be rigid in the width direction W to maintain lateral spacing of sub-arches 23 and 26 and sub-arches 33 and 36. Requiring cross ties 40 to have shear rigidity in all directions in their RW planes is sufficient, since shear rigidity in any direction assures tensile and compressive rigidity in directions plus or minus 45° to the shear direction.

For the above reasons, it is realistic to refer to cross ties 40 as RW ties. The tensile and compressive rigidity of RW ties and their arch connecting means in directions radial to the biarch centroid curve at RW tie locations must be sufficient to resist relative radial displacement between arches 20 and 30, as described above. They should additionally have, with their arch connecting means, sufficient shear rigidity in the radial-width plane to resist relative displacement between arches 20 and 30 in the width direction, also as described above. This will force the biarch framing member to act as a unit, resisting rotational buckling with the polar moment of inertial of the entire biarch and not just with the sum of the much lower polar moments of inertia of the individual arches 20 and 30.

Analysis of the lateral buckling of arches uses the same theory as the buckling of columns in directions of minimum second moments of area (Ref. 7, S. Timoshenko and G. H.

MacCullough, *Elements of Strength of Materials,* 3rd. ed., D. Van Nostrand Co., Inc.). Consider biarch 10 in FIG. 1. The minimum second moment of area, in the width direction, with respect to the R axis, which biarch 10 must have in order to limit the maximum lateral deflection $\Delta W_{max}$ in the W direction, as a fraction of the initial maximum eccentricity $ec_{max}$ of compression forces $P_{\Delta/ec}$ is, $$I_{w\,min}=P_{\Delta/ec}*L_{bacc}^2/[(k^2*E*\mathrm{ArcCos}^2(1/(1+\Delta W_{max}/ec_{max})))]$$

where: $I_{w\,min}$ is the minimum second moment of the biarch area, in the W direction, with respect to the R axis, which in biarch 10 does not vary along centroid curve 50;

k is the number of quarter waves in the buckled length $L_{bacc}$, the length of centroid curve 50 between points of intersection with chord line 90. k=2, where both biarch ends are pinned and free to rotate about the R axis. k=3, in the more likely case where the ridge end is pinned and the base end can be considered fixed and not free to rotate about the R axis;

$ec_{max}$ is the maximum expected initial eccentricity of compressive loads $P_{\Delta/ee}$ in the W direction considering biarch design, manufacture and installation in an arched structure.

$\Delta W_{max}$ is the maximum permissible lateral deflection of biarch 10 in the W direction;

$P_{\Delta/ec}$, $L_{abcc}$ and E are defined above.

Using $P_{\Delta/ec}=M_{max}/h_{max}$, $M_{max}=2*\sigma_{m\,max}*I_{d\,max}/d_{max}$, $$\sigma_{m\,max} = e_{max}*E,\ \text{and}\ e_{m\,max}=e_{uit}*(e_{m\,max}/e_{uit}),$$

$$I_{w\,min}/I_{d\,max}(\%)=200*e_{uit}*(e_{m\,max}/e_{uit})*L_{bacc}^2/$$

$$[h_{max}*d_{max}*k^2*\mathrm{ArcCos}^2(1/(1+\Delta W_{max}/ec_{max}))].$$

Here, $I_{w\,min}$ is the minimum second moment of area, with respect to the R axis, as a percentage of $I_{d\,max}$, of biarch 10 which will limit lateral buckling deflection to $\Delta W_{max}$, as a fraction of the maximum expected initial eccentricity $ec_{max}$ of applied compressive loads $P_{\Delta/ec}$. All factors in this equation are defined above.

Figure 6:
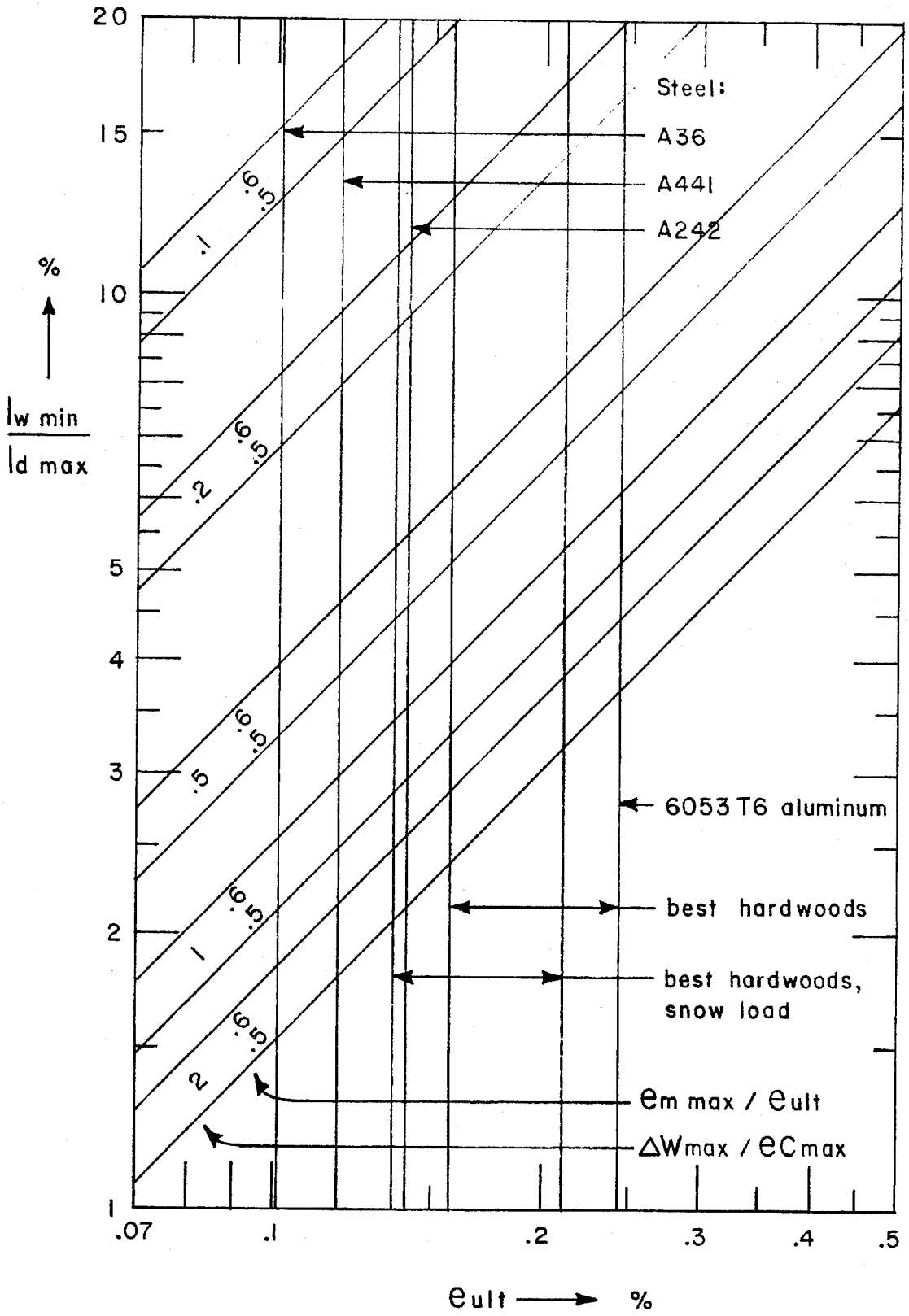
FIG. 6 is a graphical representation of the ratio of minimum second moment of area (moment of inertia) in the width direction, with respect of the radial axis, to the maximum second moment of area in the depth direction, with respect to the width axis, required to make biarch framing members self-stable against excess buckling, without lateral support. Critical biarch characteristics are arch strain capacity, biarch structural efficiency, the ratio of maximum allowable lateral deflection to maximum expected load eccentricity and the free/fixed nature of the end connections.

Assuming values for $L_{bacc}$, $h_{max}$ and $d_{max}$ of biarch 10, FIG. 1, quantitative effects of allowable $\Delta W_{max}/ec_{max}$, arch tangential strain capacity $e_{uit}$ and biarch structural efficiency $e_{m\,max}/e_{uit}$ on the minimum lateral second moment of area, with respect to the R axis, $I_{w\,min}$, as a percentage of the maximum second moment of biarch area, in the R, or depth, direction, with respect to the W axis, $I_{d\,max}$, has been computed and illustrated in FIG. 6. Biarch 10 was assumed pinned at both ends, k=2. Results of FIG. 6 would have to be reduced by 4/9 to apply to the case of a biarch framing member with a pinned ridge connection and a fixed base connection.

Most biarch framing members with pinned-pinned ends will have $I_{w\,min}$ between two and twenty percent of $I_{d\,max}$. Biarch applications where the base end can be considered fixed will have $I_{w\,min}$ between one and ten percent of $I_{d\,max}$. The primary purpose for preferring that arches 20 and 30 be divided into halves and separated in the width direction by a distance LS was to make $I_w$, equal or greater than $I_{w\,min}$, sufficiently large that the biarch framing members would be self-resistant to excessive lateral deflections, without depending on lateral support from purlins, cladding, etc.

When internal reaction force-$P_{\Delta/ec}$ in FIG. 3 is eccentric to axis R, it not only causes lateral deflections in the W direction, it also causes bending stresses increasing linearly from the R axis to both limits of $W_{ba}$. The maximum of these stresses is, $$\sigma_{ec\,max}=P_{66/ec}*ec_{max}*W_{bd}/(2*I_w)$$

which is needed below.

9. Cross Tie Spacing

The ultimate stress capacity $\sigma_{uit}$ in tangential directions of arches 20 and 30 in FIGS. 1, 3 and 5 has four components, $$\sigma_{uit}=\sigma_{m\,max}+\sigma_n+\sigma_{ec\,max}+\sigma_{cts\,max}$$

All have been determined above except for $\sigma_{cts\,max}$, the maximum arch bending stress due to cross tie spacing. Therefore, $$\sigma_{cts\,max}=\sigma_{uit}-\sigma_{m\,max}-\sigma_n-\sigma_{ec\,max}$$

Figure 7:
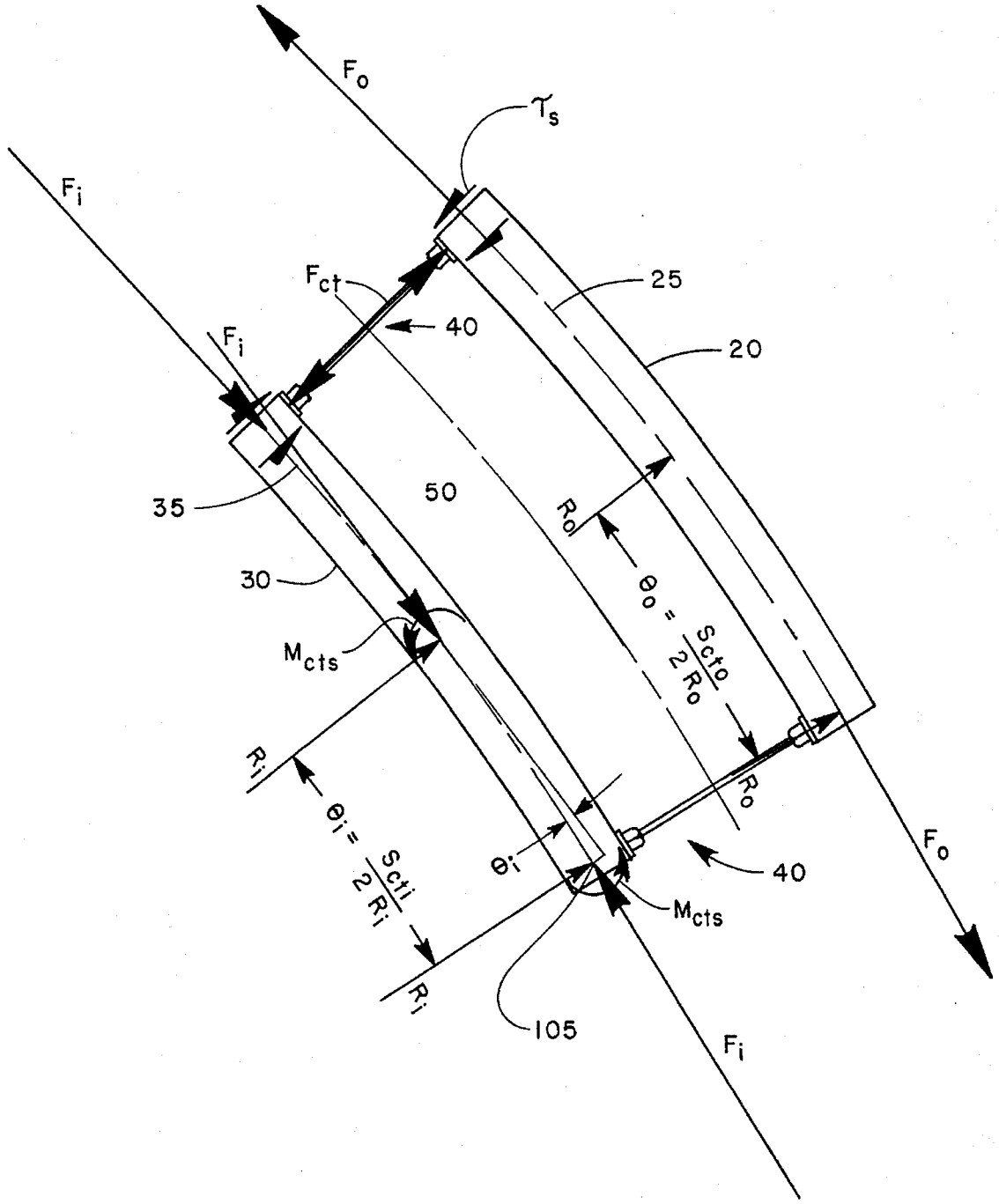
FIG. 7 is a front elevation view of the middle segment of the biarch framing member shown complete in FIG. 1. It is enlarged here as a free body diagram to shown internal reaction forces and moments in arches and cross ties.

Now that $\sigma_{cts\,max}$ has been quantified, the maximum cross tie spacings along the centroid curves 25 and 35, in FIG. 7, of outside arch 20 and inside arch 30 can be determined. Consider inside arch 30 in FIG. 7. Assume half of the segment of inside arch 30, over arc angle $\theta_1$, a free body acted upon by two internal reaction forces $F_i$. These two forces are not quite collinear, by the small angle, $\theta_i$ where, $$\theta_i=S_{cti}/2/R_i$$

Since no rotation of the free body occurs in the biarch coplane about point 105, $$F_i*R_i*\theta_i^2/2=2*M_{cts}$$

where the two counterclockwise moments $M_{cts}$ are equal on the theory of minimum elastic strain energy.

Then, $$\sigma_{ctsi}=F_i*S_{cti}^2*t_d/(32*R_i*I_a)$$

where:

$$F_i=[\sigma_{m\,max}*(1-t_d/d_{max})+\sigma_n]*W_a*t_a;$$

$I_a=W_a*t_a^3/12$, for arches of rectangular cross section.

Again, arch width $W_a$ does not include the hole diameters for cross tie bolts 46, in FIG. 5.

Combining the above three equations, the maximum cross tie spacing along inside arch 30's centroid curve 35 occurs when $\sigma_{ctsi}=\sigma_{cts\,max}$, $$S_{cti\,max}=[(8*R_i*t_a\sigma_{cts\,max})/(3*(\sigma_{m\,max}*(1-t_d/d_{max})+\sigma_n))]^{0.5}$$

A similar expression is valid for cross tie spacings along arch centroid curve 25 of outside arch 20, except the sign of $\sigma_{m\,max}$ will change relative to that for $\sigma_n$ and outside radius $R_a$ is used. One of these two spacings will limit, where cross ties 40 are kept perpendicular to biarch centroid curve 50.

Notice that the spacings of the cross ties along the arch centroid curves increase with arch radius to the 0.5 power. This is one of the major advantages of the biarch concept, keeping the number cross ties required for each framing member to a minimum and increasing the aesthetic appeal of the biarch.

10. Cross Tie Forces

Cross tie force & Arch Shear Stresses $F_{ct}$ is, $$F_{ct}=(|F_i|*S_{cti}/R_i+|F_0|*S_{cto}/R_0)/2$$

Tangential stress $\sigma_{ec}$ does not contribute to net cross tie force. Therefore, $$F_i=[\sigma_{m\,max}*(1-t_d/d_{max})+\sigma_n]*W_a*t_a;$$

$$F_0=[-\sigma_{m\,max}*(1-t_d/d_{max})+\sigma_n]*W_a*t_a.$$

Cross tie force $F_{ct}$ is resisted by shear stress $\tau_{ct}$ on both sides of cross tie end bars 44 with a parabolic distribution which peaks at mid-thickness.

$$\tau_{ct\,max}=(3*F_{ct})/(4*W_a*t_a)$$

Near the biarch ends, end forces $P_{\Delta/ec}$ have components normal to biarch centroid curve 50 which will produce shear stresses $\tau_{et}$ in arches 20 and 30 which will add to those produced by cross ties 40 adjacent the biarch ends.

$$\tau_{s\,max}=\tau_{ct\,max}+\tau_{et\,max}$$

What is claimed is:

1. A biarch framing member comprising:

a pair of coplanar arches curved in the same direction over at least a portion of the length of their common areal centroid curve, each of said arches having a nearly constant width over said curved length portion; and a pair of RT ties, spaced apart along said common centroid curve length, each of said RT ties including arch connecting means and having sufficient tensile and compressive rigidity, in the direction radial to said centroid curve at the location of each said RT tie, to resist relative displacement between said arches in said radial direction, and also having sufficient shear rigidity in its radial-tangential plane to resist relative displacement between said arches in the direction tangential to said centroid curve at each said RT tie location, at least one said RT tie spacing said arches apart in said radial direction at the location of said at least one RT tie; and at least one RW tie connecting said arches in said curved length portion at a location between said RT tie locations and spacing said arches apart in the direction radial to said centroid curve at said RW tie location, said RW tie including arch connection means having sufficient tensile compressive rigidity in said radial direction to resist relative displacement between said arches in said radial direction, but having effectively less shear rigidity in its radial-tangential plane than said shear rigidity in said radial-tangential plane of each said RT tie.

2. The biarch framing member according to claim 1 wherein said at least one RW tie, including said arch connecting means, also has sufficient shear rigidity in its radial-width plane to resist relative displacement between said arches in the width direction of said centroid curve at said RW tie location.

3. The biarch framing member according to claim 2 wherein said sufficient shear rigidity in said radial-width plane of said at least one RW tie is greater than said effectively less shear rigidity in said radial-tangential plane of the same said RW tie.

4. The biarch framing member according to claim 1 wherein each said arch has a ratio of maximum width to minimum width of less than two-to-one over said curved length portion.

5. The biarch framing member according to claim 1 wherein said shear rigidity, in said radial-tangential plane, of at least one of said RT ties is provided by an adjacent structural member attached thereto.

6. The biarch framing member according to claim 1 wherein the coplane of said arches is a reference plane lying the minimum root-mean-square distance from said common areal centroid curve.

7. The biarch framing member according to claim 6 wherein each said arch has an arch cross section areal centroid curve lying a root-mean-square distance from said coplane which is less than the maximum biarch width at a location on said common areal centroid curve where the biarch depth, in the radial direction, is a maximum.

8. The biarch framing member according to claim 7 wherein said curved length portion is that portion of said common areal centroid curve where any plane normal to said common centroid curve intersects both of said arch cross section areal centroid curves at points where the radii of curvature at said points are finite and both of said arch cross sectional areal centroid curves are concave at said points when viewed from the center of curvature of either of them.

9. The biarch framing member according to claim 1 wherein at least one said arch is divided into two or more sub-arches which are spaced apart in the width direction of said centroid curve normal to said radial-tangential plane of said at least one RW tie.

10. The biarch framing member according to claim 1 wherein the ratio of maximum depth of said biarch, in the direction radial to said common centroid curve, to the maximum height of said common centroid curve above a chord line connecting points of loading at opposite ends of said biarch framing member, is less than two.

11. The biarch framing member according to claim 1 wherein at the location on said common areal centroid curve where the biarch depth in a radial direction is the maximum, the second moment of area in the width direction of said centroid curve with respect to an axis in the radial direction originating at said centroid curve is greater than one percent of the second moment of area in the depth, or radial, direction of said centroid curve with respect to an axis in the width direction originating at said centroid curve.

12. The biarch framing member according to claim 1 wherein said at least one RW tie is one of three or more RW ties which have tangential spacing between adjacent of said RW ties which increases with increasing radius of curvature of said common centroid curve.

13. The biarch framing member according to claim 1 wherein said arches have ultimate useful strain capacities, in tangential directions of said common areal centroid curve, of less than one percent.

14. The biarch framing member according to claim 1 wherein at least one of said arches is made of wood.

15. The biarch framing member according to claim 14 wherein said wood has a specific gravity greater than one-half, at an adjusted moisture content of twelve percent.

16. The biarch framing member according to claim 14 wherein said wood is one of the conifer species.

17. The biarch framing member according to claim 1 wherein at least one of said arches is made from an alloy of aluminum.

18. The biarch framing member according to claim 1 wherein at least one of said arches is made from an alloy of iron.

19. The biarch framing member according to claim 1 wherein at least one of said arches is made from a fiber reinforced polymer.

20. The biarch framing member according to claim 1 wherein at least one of said arches is made from steel reinforced concrete.

21. The biarch framing member according to claim 1 wherein at least one of said RT ties and its said arch connecting means are made entirely or partially of metal.

22. The biarch framing member according to claim 1 wherein said least one RW tie and its said arch connecting means are made entirely or partially of metal.

23. The biarch framing member according to claim 1 wherein at least one of said RT ties and its said arch connecting means are made entirely or partially of wood.

24. The biarch framing member according to claim 1 wherein said least one RW tie and its said arch connecting means are made entirely or partially of wood.

25. The biarch framing member according to claim 1 wherein at least one of said arches is hyperbolic in shape.

26. The biarch framing member according to claim 1 wherein at least two of said biarch framing members are connected together, forming a biarch frame.

* * * * *